United States Patent [19]

Urwyler et al.

[11] Patent Number: 4,848,201

[45] Date of Patent: Jul. 18, 1989

[54] APPARATUS FOR DISPENSING STRIP MATERIAL OR THE LIKE AND CARTRIDGE THEREFOR

[75] Inventors: Peter R. Urwyler, Modesto; John W. Toor; James E. Sacherman, both of Palo Alto, all of Calif.

[73] Assignee: Simtek Inc., Modesto, Calif.

[21] Appl. No.: 910,639

[22] Filed: Sep. 23, 1986

Related U.S. Application Data

[63] Continuation-in-part of Ser. No. 651,263, Sep. 17, 1984, Pat. No. 4,638,696.

[51] Int. Cl.[4] ..... B26D 5/22; B65H 35/07

[52] U.S. Cl. ..... 83/261; 83/205; 83/566; 83/568; 83/649; 225/46

[58] Field of Search ..... 83/649, 261, 205, 566, 83/568; 225/46

[56] References Cited

U.S. PATENT DOCUMENTS

| | | | |
|---|---|---|---|
| 2,579,149 | 12/1951 | Krueger et al. | 225/46 |
| 2,822,046 | 2/1958 | Krueger | 83/649 X |
| 2,959,998 | 11/1960 | Etzenhouser | 83/369 |
| 3,072,000 | 1/1963 | Bracey et al. | 83/568 X |
| 3,144,184 | 8/1964 | Yerkes | 225/47 X |
| 3,177,750 | 4/1965 | Amenna | 83/261 X |
| 3,237,595 | 3/1966 | Kilham | 118/42 |
| 3,283,631 | 11/1966 | Strom | 83/211 |
| 3,465,629 | 9/1969 | Krueger | 83/205 |
| 3,798,108 | 3/1973 | Ioannilli | 83/566 X |
| 3,802,309 | 4/1974 | Bosland | 83/176 |
| 4,325,277 | 4/1982 | Uchida et al. | 83/205 |
| 4,455,905 | 6/1984 | Raymond | 83/649 X |
| 4,513,647 | 4/1985 | Eckelt et al. | 83/261 |
| 4,638,696 | 1/1987 | Urwyler | 83/261 |

*Primary Examiner*—Donald R. Schran

*Attorney, Agent, or Firm*—Worrel & Worrel

[57] ABSTRACT

An apparatus for dispensing strip material and the like from a source of the material, the apparatus having a frame; a mount borne by the frame for receiving a source of the material; a drive member mounted on the frame for feeding a strip of material from the source of the material; and a control member mounted on the frame for movement toward and from the drive member and selectively positionable to carry a strip of the material extended between the control member and the drive member into engagement with the drive member selectively to feed the strip of material from the source of material. A cartridge assembly operable with the apparatus to serve as a source of the material and having portions cooperating with the apparatus to feed the material.

13 Claims, 7 Drawing Sheets

M

APPARATUS FOR DISPENSING STRIP MATERIAL OR THE LIKE AND CARTRIDGE THEREFOR

FIELD OF THE INVENTION

This application is a continuation-in-part of application Ser. No. 06/651,263 filed on Sept. 17, 1984 now U.S. Pat. No. 4,638,696.

The present invention relates to an apparatus for dispensing strip material or the like to and a cartridge therefor and more particularly to such an apparatus and cartridge assembly which are unusually well suited to the dispensing of strip material such as adhesive tape from a roll of such material in selectively determinable lengths and without having physically to contact the strips during the dispensing operation.

DESCRIPTION OF THE PRIOR ART

There are a variety of materials which must be dispensed from continuous sources of the material on a frequent basis where the length of the material to be dispensed may vary substantially from one instance to the next. For example, such materials as ribbon, string, wire, postage stamps and a wide assortment of other materials are commonly dispensed from rolls of such material. Prior art devices designed for such dispensing operations have suffered from several chronic problems which have prevented their being accepted for common usage. A lack of dependability as the result of jamming of the operative mechanisms have been a primary impediment. These problems are compounded in devices particularly adapted to the dispensing of adhesive material such as adhesive tape. Whether the particular form of tape is cloth type electrician's tape, opaque plastic electrician's tape, masking tape, reinforced wrapping tape, paper tape, clear plastic tape, surgical tape, or any of a host of other types of adhesive tapes commonly used, jamming of the operative mechanism of prior art dispensing devices has been almost certain due to contact of adhesive surfaces with the operative mechanism of the dispensing devices. In such prior art devices, the adhesive material borne by the tape is simply transferred over time to the surfaces within which it comes in contact and that transferred adhesive interferes with the working parts of the device. Furthermore, the transferred adhesive may adhere to otherwise nonadhesive portions of the tape so that the tape itself becomes fouled.

Still another chronic difficulty encountered in prior art dispensing devices, whether for dispensing adhesive tape or other type materials, is the propensity for slack to form in the lead portion of the material within the device which may become entangled in the operative mechanism thereby jamming the device.

Therefore, it has long been known that it would be desirable to have an apparatus for dispensing strip material from a source of said material which operates dependably, rapidly, and in such a way as to permit the operator selectively to determine the length of the strip of material to be dispensed and which, while possessing these capabilities, operates in such a manner as virtually to preclude jamming of its operative components.

OBJECTS AND SUMMARY OF THE INVENTION

Therefore, it is an object of the present invention to provide an improved apparatus for dispensing strip material or the like.

Another object is to provide such an apparatus which is particularly well suited to the dispensing of a variety of ribbon or strip materials from a continuous roll of such material and which is particularly adapted for the dispensing of adhesive tapes such as transparent plastic adhesive tape.

Another object is to provide such an apparatus which is operable to dispense adhesive tape rapidly and dependably in portions of selected lengths, while reducing to an absolute minimum the possibility of becoming jammed.

Another object is to provide such an apparatus which cooperates with the natural properties of the adhesives borne by adhesive tape to handle the dispensing of such adhesive tape from the roll in such a manner virtually to preclude jamming.

Another object is to provide such an apparatus which is operable to sever precisely defined selected portions of adhesive tape in accordance with the needs of the operator without requiring any contact between the operator and the adhesive tape until after such severing is achieved and which uses the natural adhesive properties of the adhesive tape to hold the segment so severed in position for grasping by the operator.

Another object is to provide such an apparatus which can easily be loaded with a source of the material to be dispensed without requiring any complicated feeding of the lead portion of the strip material into the dispensing mechanism.

Another object is to provide such an apparatus which has improved operative components for dependable operation.

Another object is to provide such an apparatus which has a disposable cartridge assembly which deploys the strip material to be dispensed.

Another object is to provide such an apparatus which operates cooperatively with the adhesive properties of adhesive tape automatically, releasably to retain a segment of tape once severed in a ready position for grasping by the user, but which avoids contact with all but a minimum of the adhesive surface area thereof so as to preserve the adhesive properties thereof.

Another object is to provide a cartridge operable in an apparatus for dispensing strip material which contains a source of such strip material and retains a lead portion thereof in position for operatively mating with the apparatus in feeding relation thereto and which, once the source of strip material is exhausted, can be disposed of and replaced with another of the cartridges containing a source of such strip material.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figures 1, 2, 6, 8:
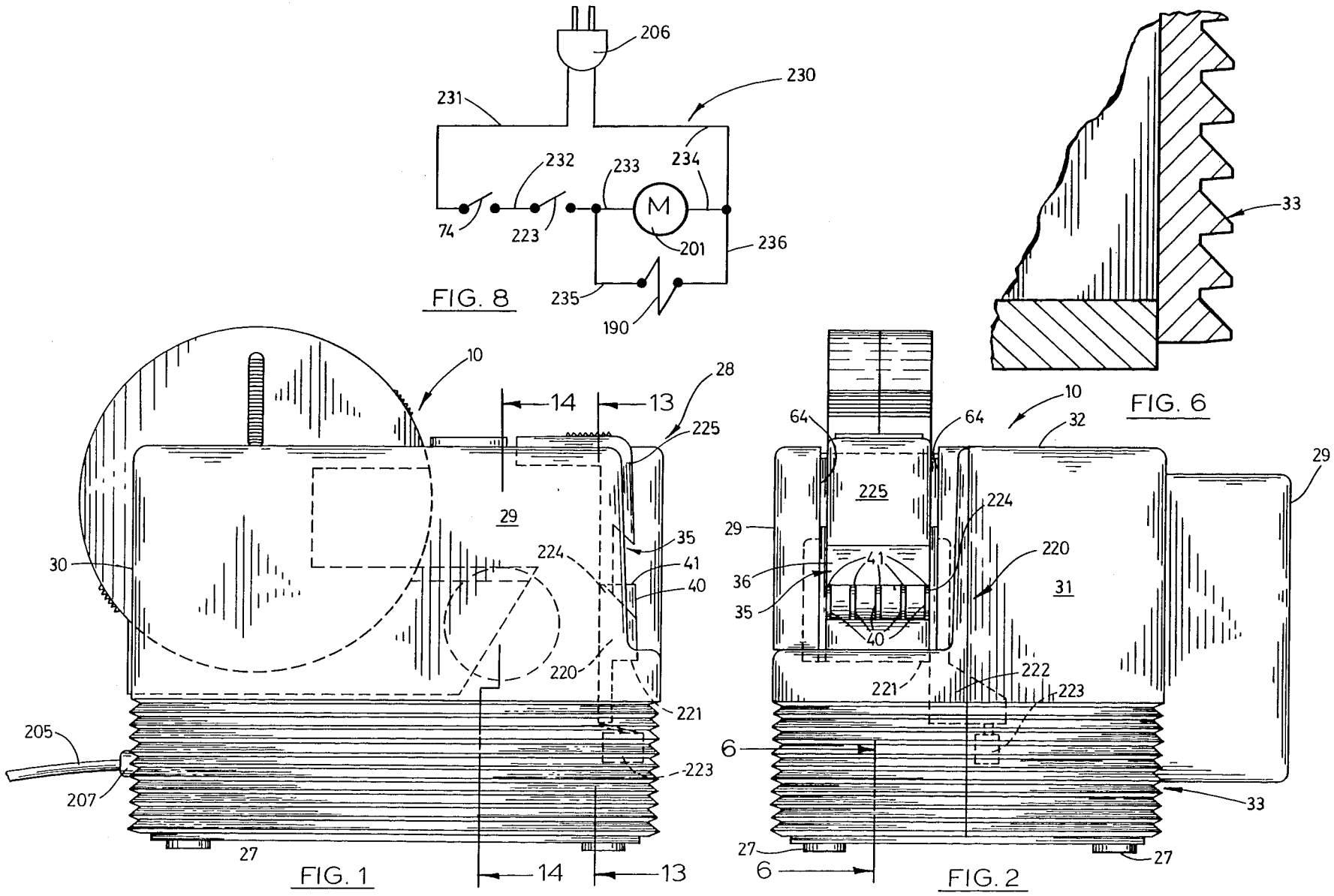
FIG. 1 is a side elevation of the apparatus of the present invention showing the cartridge assembly thereof in its installed position.
FIG. 2 is a front elevation of the apparatus of FIG. 1 showing the tape dispensing opening therefor.
FIG. 6 is a somewhat enlarged fragmentary transverse vertical section taken from on line 6—6 in FIG. 2 and showing the configuration of the base of the housing adjacent to the tape dispensing opening.
FIG. 8 is a schematic diagram of the electrical system of the apparatus of the present invention.
Figure 3:
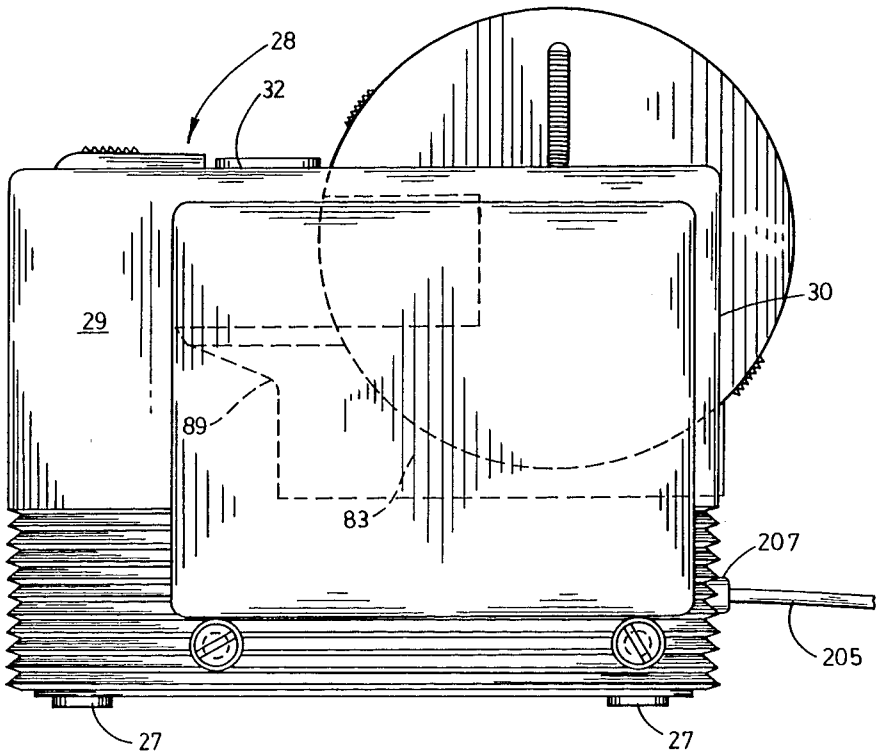
FIG. 3 is a side elevation of the apparatus opposite to that shown in FIG. 1.

Referring more particularly to the drawings, the apparatus for dispensing strip material or the like of the present invention is generally indicated by the numeral 10 in FIG. 1.

As will become more clearly apparent, the apparatus 10 is adapted to dispense strip material or the like from a source of material, and is particularly well suited to dispensing adhesive tape from a roll of adhesive tape. For illustrating the operation of the apparatus, a conventional roll of adhesive tape is generally indicated by the numeral 11 in FIG. 9. In order more clearly to understand the operation of the apparatus when dispensing tape from such a roll it will be understood that the adhesive tape of the roll 11 is of the transparent or semitransparent, plastic type having a single adhesive surface. The roll has a cylindrical core 12 containing a cylindrical opening 13 substantially concentric to the cylindrical core. Adhesive tape 14 is concentrically wound about the core in the conventional manner to form the roll. During use, a lead portion 15 is pulled from the roll as the tape is used. The tape has an adhesive surface 16 and an opposite non-adhesive surface 17.

While the apparatus 10 is described herein for dispensing tape from a roll 11, it will be understood that the apparatus can be employed to dispense a variety of types of strip material and the like and the invention hereof is not limited to dispensing adhesive tape.

Figure 4:
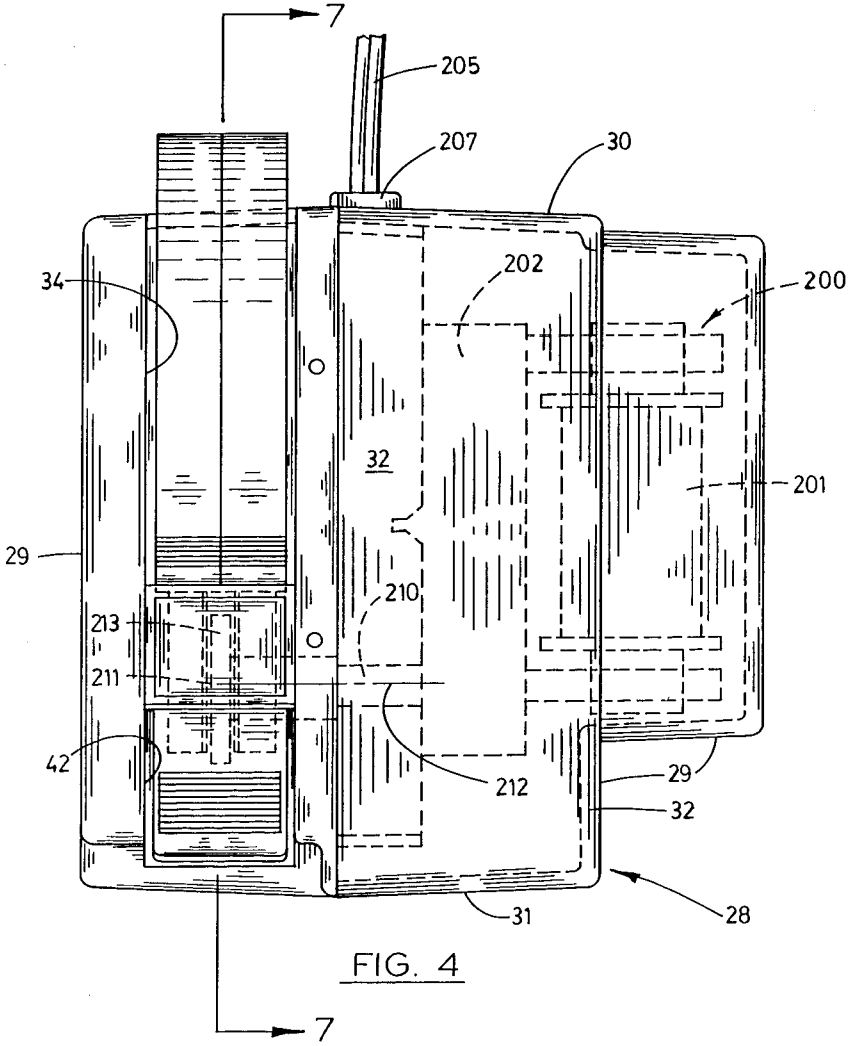
FIG. 4 is a top plan view of the apparatus of FIG. 1.
Figure 7:
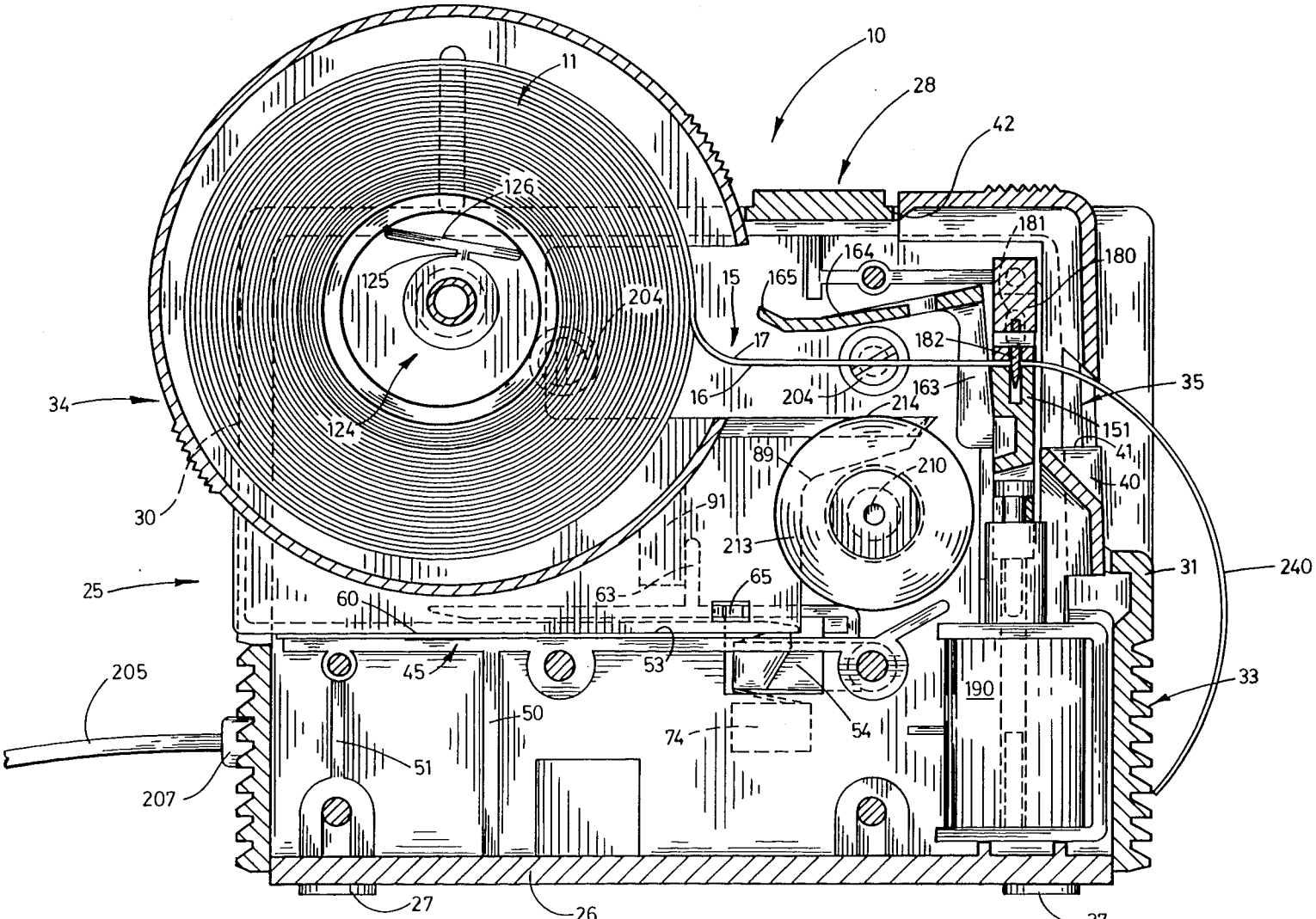
FIG. 7 is a somewhat enlarged longitudinal vertical section taken on line 7—7 of FIG. 4 showing the control mechanism of the apparatus in the severing mode.

As best seen by reference to FIG. 7, the apparatus 10 has a box-like frame or housing generally indicated by the numeral 25. The housing has a substantially flat floor 26 on which are mounted four rests 27, only two of which are shown in FIG. 7, in positions for supporting the floor on a supporting surface, not shown. The housing has a cover, generally indicated by the numeral 28, which is composed of a pair of spaced side walls 29, a rear wall 30, a front wall 31 and a top wall 32. Side wall 29 on the right, as viewed in FIGS. 2 and 4, extends outwardly to enclose portions of the internal mechanisms of the apparatus; more specifically, the electric motor thereof as will hereinafter be described. Formed in the spaced side walls, rear and front walls is a ribbed surface generally indicated by the numeral 33 and extending about the walls of the housing adjacent to the floor 26. As will be understood from a study of FIGS. 2 and 6, the ribbed surface, which is positioned on the front wall 31 functions to prevent the adhesive tape 14 which is expelled from the apparatus from securely adhering to that surface, as will hereinafter be described in greater detail. An insertion opening 34 is provided in the cover of the housing and extends through the rear wall 30, and the top wall 32, of the cover. A recess 35 is formed in the front wall of the cover and communicates with a somewhat larger dispensing opening 36. As best understood by reference to FIGS. 1 and 2, the recess 35 is dimensioned to prevent a user of the apparatus from inserting his or her fingers into the apparatus. Deployed in predetermined fixed spaced relation in the area of the recess 35 are a plurality of ribs 40. The ribs 40 have upper tape contact surfaces 41 which are adapted to receive the adhesive tape 14 in a fashion such that it can be easily grasped by the operator of the apparatus. A rectangular opening 42 is provided in the top wall 32. The precise size, configuration and positioning of the openings 34, 35 and 42 are preferably those best shown in FIGS. 1 and 4.

A cartridge platform 45 is mounted in the housing 25 in alignment with and between the insertion opening 34 and the dispensing opening 36. The cartridge platform includes a first support 50 mounted in upstanding relation to the floor 26 and a second support 51 which is mounted on the floor 26, and spaced a predetermined distance from the rear wall 30. A floor 53 is mounted on the upper ends of the first and second supports in substantially parallel relation to the floor 26 of the housing, and extending from a position immediately adjacent to the insertion opening 34 to a position spaced from the front wall 31 of the cover 28; a distance somewhat slightly below the dispensing opening 36. The floor 53 has formed therein a switch opening 54, which can best be seen by reference to FIGS. 7 and 9. A pair of spaced substantially vertical side walls 55 are mounted on the floor 53 and are in substantially parallel relation to the side walls 29. The side walls 55 extend from a position immediately adjacent to the insertion opening 34 to an area immediately adjacent to the dispensing opening 36.

Figure 9:
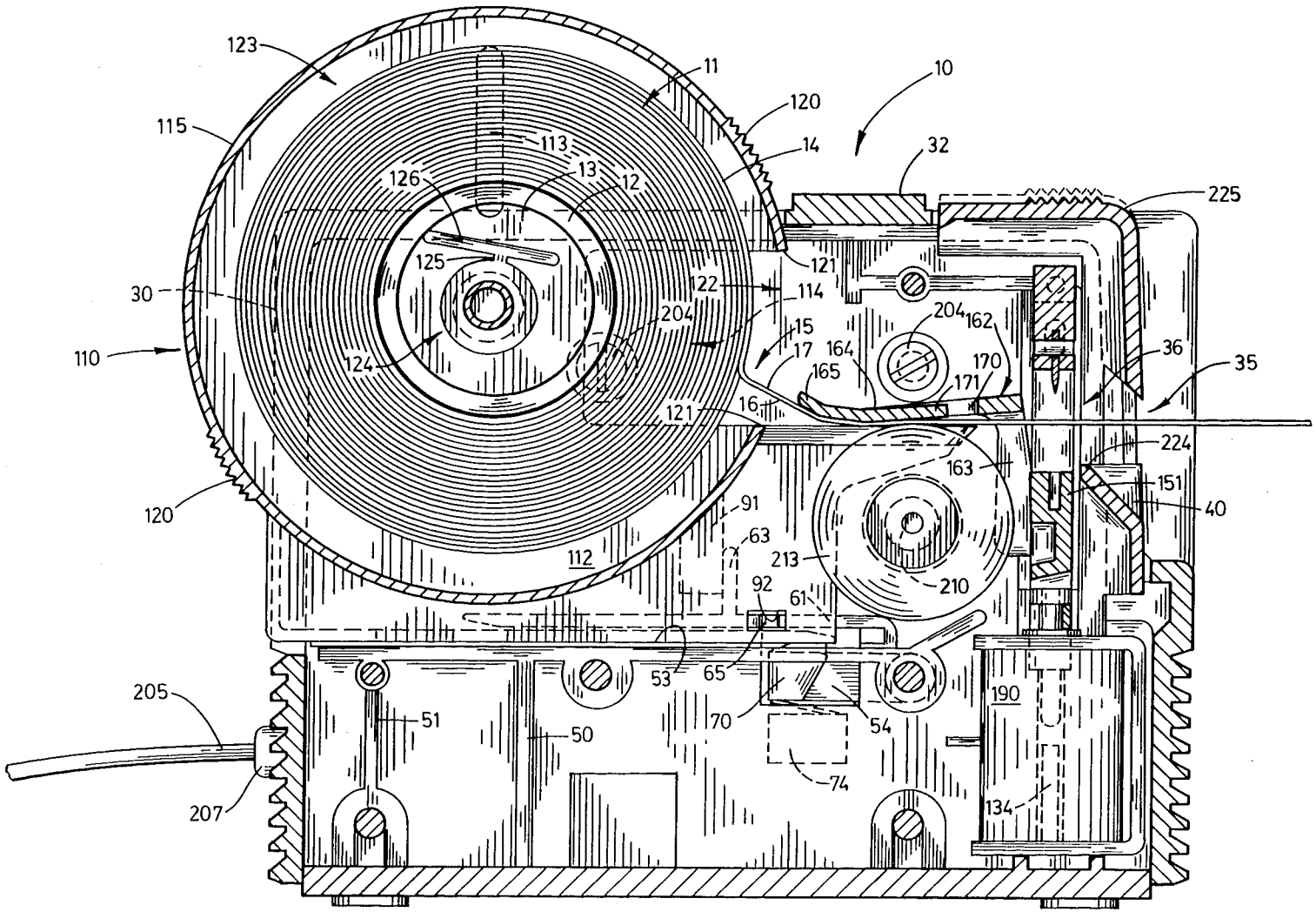
FIG. 9 is a somewhat enlarged, longitudinal vertical section corresponding to that of FIG. 7, but showing the control mechanism of the apparatus in the feeding mode.
Figure 14:
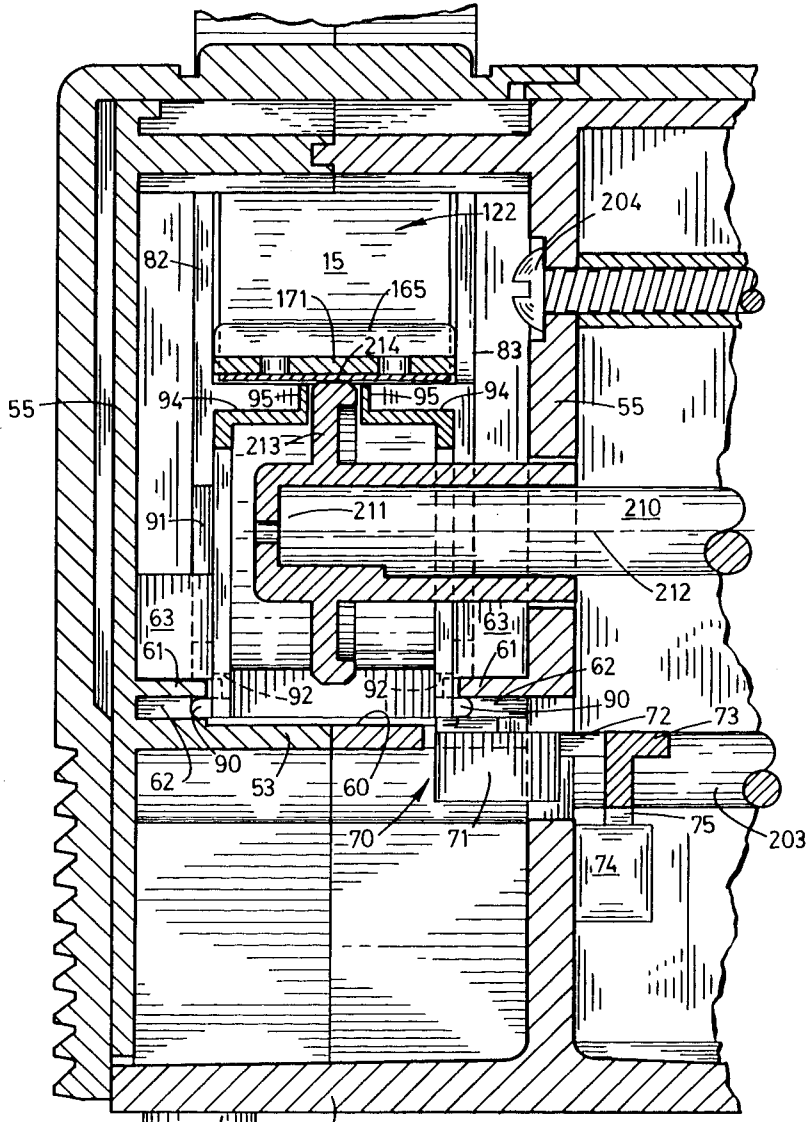
FIG. 14 is a somewhat enlarged, fragmentary, transverse vertical section taken on line 14—14 in FIG. 1 showing the control mechanism i the feeding mode.

The floor 53 has an upper surface 60. Deployed from the side walls 55 is a pair of guides 61 which are deployed in substantially parallel relation to each other, and to the longitudinal axis of the floor 53. As shown in FIGS. 9 and 14, the guides 61 are positioned a predetermined distance from the upper surface 60 to define channels 62. A stop 63 is mounted on the guides 61 and affixed to the side walls 55. This is best illustrated by reference to FIG. 9. The two side walls 55 define the rectangular insertion opening 34. Mounted on the side walls 55 are cartridge locking members 65. The cartridge locking member is of a somewhat flexible construction.

Extending through the switch opening 54 that is defined by the floor 53 is a switch member 70 which is best seen by reference to FIG. 9. As shown most clearly by reference to FIG. 4, the switch member 70 is rotatably deployed in an appropriate attitude by the side wall 55, which is on the right as viewed in FIG. 14. The switch member has a main body 71 which is adapted for rotational movement about an axle 72. The axle 72, has attached at one of its ends an L-shaped member 73. The L-shaped member rides in contact with a first electrical microswitch 74 mounted on the side wall 55 in the fashion as illustrated in FIG. 14. It should be understood that a spring biased arm 75 is operably attached to the first electrical microswitch and is adapted to urge the main body 71 to rotate in a counterclockwise direction, as viewed in FIG. 9, to cause the switch member 70 to protrude somewhat slightly out through the switch opening 54. As should be understood by a study of FIG. 7, when the switch member 70 is depressed, the first electrical microswitch 74 is placed in an electrically closed condition.

A cartridge or cartridge assembly 80 for mounting a source of strip material to be dispensed is dimensioned to be received in the insertion opening 34 and slidably moved within the housing 25 along the cartridge platform 45. The cartridge has a cartridge base, generally indicated by the numeral 81, which includes a first vertical side wall 82; a second vertical side wall 83; and a third vertical side wall 84. The individual vertical side walls have a bottom edge 85; a top edge 86; a forward edge 87; and a rearward edge 88. The second vertical side wall 83 has a recessed forward edge 89.

Figure 10:
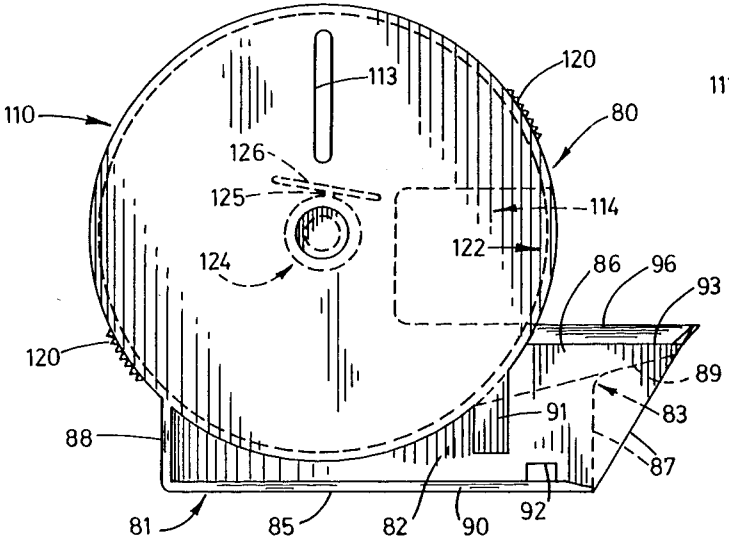
FIG. 10 is a side elevation of the cartridge of the subject invention.
Figure 12:
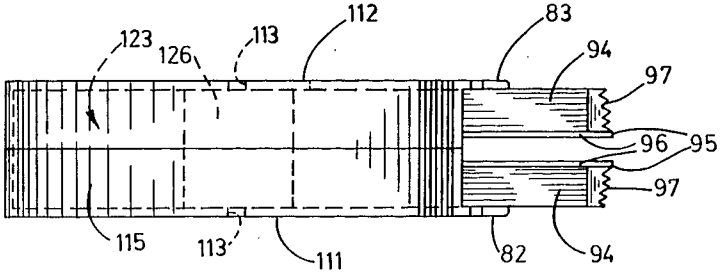
FIG. 12 is a top plan view of the cartridge of FIG. 10.
Figure 5:
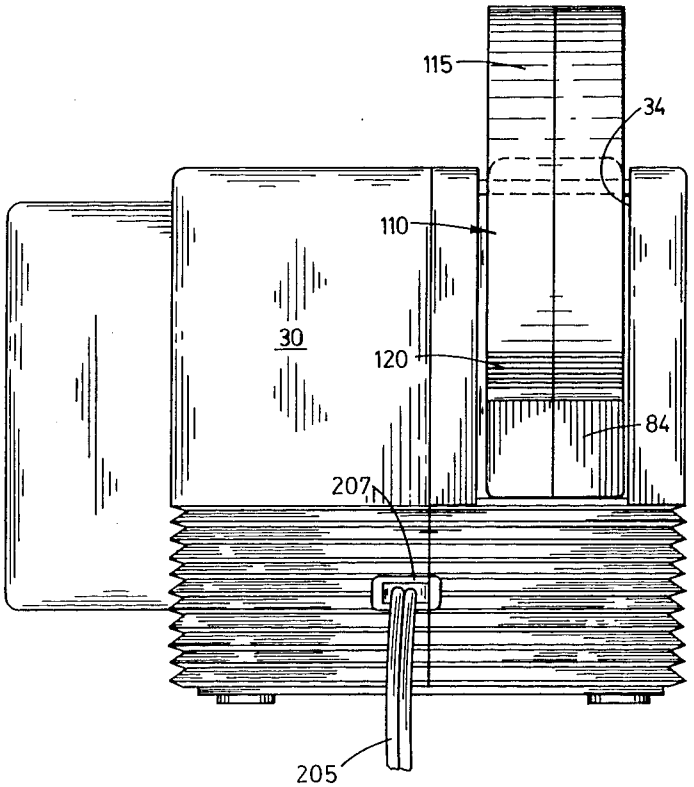
FIG. 5 is a rear elevation of the apparatus of FIG. 1.

Mounted to and depending in right-angular relation from the bottom edges 85 of the side walls 82 and 83 are horizontally mounted flanges 90, which are adapted to be slidably received and captured in the channels 62 formed between the guides 61 and the cartridge platform 45. This relationship is best illustrated by reference to FIG. 14. The vertical side walls 82, 83, and 84, respectively, as should be understood, are preferably manufactured out of a rigid yet somewhat flexible plastic material. Formed on the outside surfaces of the vertical side walls 82 and 83, are raised ribs, indicated by the numeral 91 one of which is shown in FIG. 10. As should be understood, the raised rib comes into contact with the stop 63 which limits the forward motion of the cartridge 80 along the cartridge platform. Formed in a suitable position closely adjacent to the forward edges 87 of the vertical side walls 82 and 83 are orifices 92 which are adapted individually, releasably to receive the cartridge locking members 65.

When the cartridge is moved to the fully installed position as shown in FIGS. 7 and 9, hereinafter referred to as the loaded position, the cartridge locking members are captured in the orifices 92 thus securing the cartridge 80 in the loaded position in the apparatus. Similarly, when the cartridge 80 is received in the loaded position, the flange 90, which is positioned on the right, as viewed in FIG. 14 causes the switch member 70 to be depressed. The depression of the switch member 70 causes the first electrical microswitch 74 to be placed in a closed electrical state.

The first and second vertical side walls 82 and 83 have horizontal leading edges 93. A horizontal mounting plate 94 is mounted on and extends in right-angular relation from each of the leading edges 93. The mounting plates 94 individually mount guide rails 95 which have tapered upper edges 96. Serrated blades 97 are individually mounted at a somewhat oblique angle on common ends of the guide rails, and are affixed to the guide rails and the horizontal mounting plates. Reinforcing members 98 are mounted on the individual guide rails to provide added strength.

Figure 11:
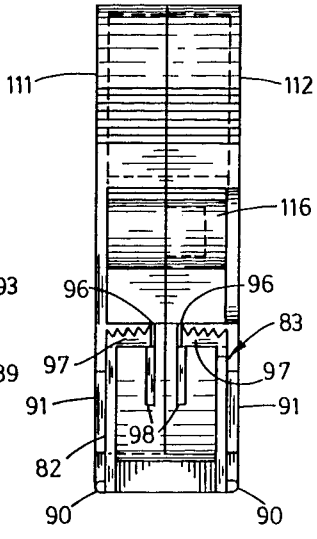
FIG. 11 is a front elevation of the cartridge of FIG. 10.

A substantially enclosed tape dispensing container 110 is mounted on the cartridge base 81, as best shown in FIGS. 9 and 10. The tape dispensing container 110 has a first side wall 111 and a second side wall 112. The first and second side walls have viewing ports 113 which permit the operator of the apparatus 10 to look into the tape dispensing container for the purpose of determining the amount of adhesive tape 14 which remains on the roll 11. As shown in FIG. 9, a portion of the second side wall 112 is recessed. This recessed area defines an access port 114, which permits the operator of the apparatus to gain access to the roll 11 for the purpose of grasping a lead portion 15 of the adhesive tape 14 or for assorted other reasons. Joining the first and second side walls together is an edge member 115 composed of separable portions individual to the side walls 111 and 112. As best understood by a study of FIG. 11, the second side wall and its respective portion of the edge member 115 is in the configuration of a cap 116 which fits in secure, mating relationship with the first side wall 111 and its respective portion of the edge member 115.

The edge member 115 has formed at two locations on its exterior surface a plurality of raised ribs 120. These raised ribs provide suitable gripping surfaces for the operator's fingers for the purpose of grasping the cartridge 80 when the cartridge is being moved into or from the loaded position. As should be understood, the edge member 115 has a leading edge 121 which defines a tape cartridge opening 122 which permits the lead portion 15 of the adhesive tape 14 to be drawn therethrough. The first and second side walls 111 and 112 and the edge member 115 define an internal chamber 123 which houses the roll 11 of adhesive tape. Suitably positioned, and depending from, the individual side walls is a mounting assembly generally indicated by the numeral 124. The mounting assembly includes a support 125 which is affixed on the individual side walls and extends outwardly therefrom. The support has a substantially flat, thin remote portion 126.

Figure 13:
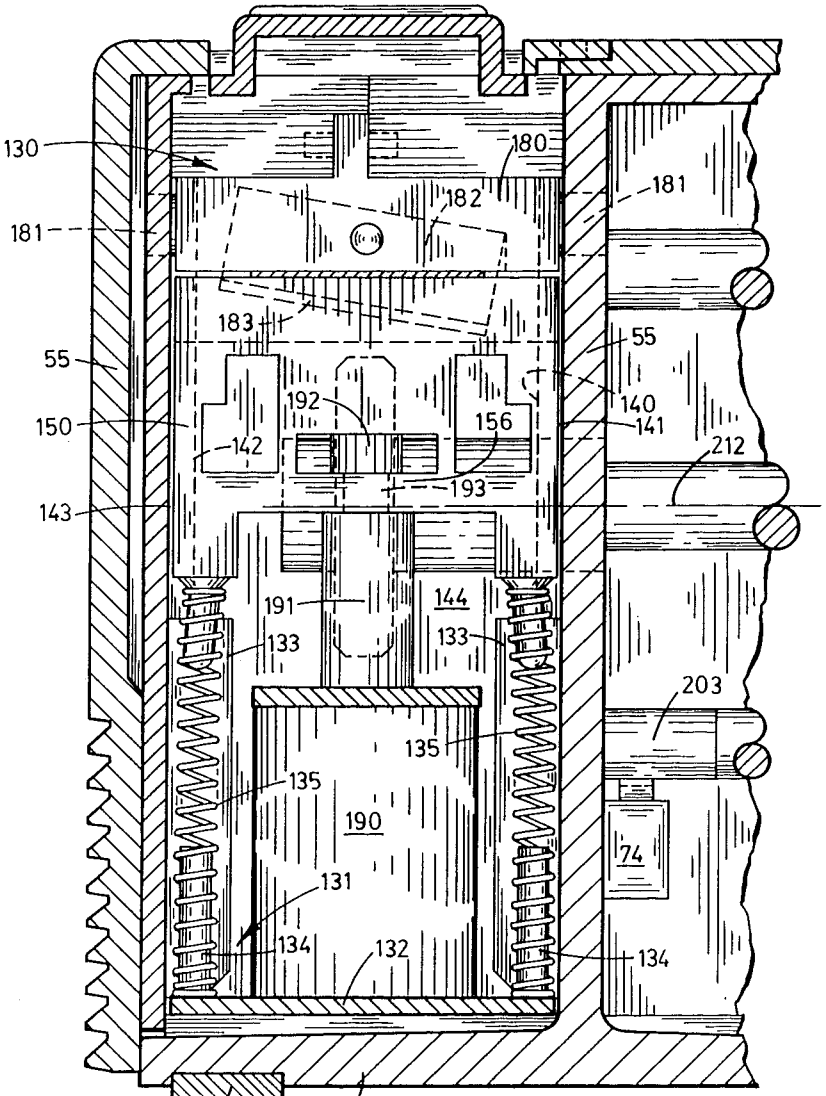
FIG. 13 is a somewhat enlarged, fragmentary, transverse vertical section taken on line 13—13 of FIG. 1 showing the control mechanism of the apparatus in the severing mode.

A control mechanism 130 is mounted on the floor 26 of the housing 25 as best seen by reference to FIG. 13. The control mechanism has a main frame 131 which includes a base plate 132 mounted on the floor 26 and a pair of side plates 133 individually mounted on opposite ends of the base plate and extending upwardly therefrom in spaced substantially parallel relation to each other and in substantially right-angular relation to the base plate. The side plates 133 deployed on the left and right, as viewed in FIG. 13, are placed preferably in facing engagement with the side walls 55. As can best be visualized upon reference to FIGS. 7 and 9, the main frame is positioned adjacent to the dispensing opening 36, of the front wall 31, of the cover 28, with the side plates 133 disposed on opposite sides and rearwardly from the dispensing opening 36. Suitably affixed and extending upwardly from the surface of the base plate 132 are spring pins 134 which are each dimensioned to receive a helical compression spring 135 thereabout.

A first pair of vertical rails 140 are mounted on the side wall 55, on the right as viewed in FIG. 13, in spaced substantially parallel relation to each other thus defining a first track 141 therebetween. A second pair of vertical rails 142 are mounted on the side wall 55 on the left as viewed in FIG. 13, in spaced substantially parallel relation to each other and defining a second track 143. The individual tracks 141 and 143 are disposed substantially in the same plane and are substantially parallel to each other thus defining a path of travel 144 along and between the tracks from the base plate 132 to a position closely adjacent to the top wall 32.

The control mechanism 130 has a control member or frame 150 mounted therein for movement along the path of travel 144. The control frame 150 has a second tape contact portion, release or mounting plate 151 having a horizontal substantially planar upper textured surface 152; the upper textured surface being deployed in a substantially normal attitude to the individual first and second tracks 141 and 143, respectively. A slot 153 is formed in the upper surface 152 and extends longitudinally thereof as can best be seen in FIGS. 13, 15, and 16. The mounting plate has a lower surface 154 which has depending therefrom in a substantially normal attitude a pair of legs 155 each of which has a distal end 156. The mounting plate also has formed in its lower surface a channel 160. As shown in FIG. 14, formed in the distal end of each of the legs 156 is a spring receiving pin 161; the spring receiving pin being mounted and extending outwardly therefrom at a slight angle, preferably five degrees from the vertical. The spring receiving pin as illustrated receives and rests in contact with the helical compression spring 135.

A feed plate assembly or first tape contact portion 162 of angulated configuration is mounted on and extends outwardly from the mounting plate 151. The feed plate assembly 162 has a pair of side plates 163 which are mounted on the mounting plate 151 in spaced substantially parallel relation to each other and which are substantially right-angularly related to the upper textured surface 152. The side plates 163 are positioned individually just inwardly of the respective adjacent first and second pair of rails 140 and 142, respectively. A first tape contact portion or angulated pressure plate 164 is mounted in a predetermined attitude with respect to the side plates and extends outwardly at the somewhat oblique angle shown in FIGS. 7 and 9, and in the general direction of the insertion opening 34 of the rear wall 30 of the cover 28. The pressure plate 164 has a distal end 165. As best seen by reference to FIGS. 15 and 16, the pressure plate has formed therein a U-shaped channel 170, which defines a spring member 171. The pressure plate has an upper surface 172, a lower, contact surface 173 and a lipped edge 174.

The blade mount 180 is affixed on the side walls 55 by suitably dimensioned pins 181, which are best seen by reference to FIG. 13. A severing blade 182 is mounted in the blade mount and is substantially centrally positioned within the path of travel 144 for receipt in the slot 153 when the mounting plate 151 is moved to the fully upwardly extended position shown in FIG. 7 and in FIG. 13, hereinafter referred to as the severing position. The blade has a cutting edge 183 which is disposed at an oblique angle as can best be seen in hidden lines in FIG. 13 for purposes of enhancing the severing ability thereof.

The pair of helical compression springs 135 are individually mounted on the base plate 132 of the main frame 131 individually within the first and second tracks 141 and 143, respectively, as can best be seen in FIG. 13. Each of the compression springs is slidably received on the spring pin 134 and, as will be hereinafter described in greater detail, the compression springs maintain the control frame 150, and more particularly the mounting plate 151 thereof in an extended or severing position shown in FIG. 13. The control frame is however positionable in a retracted, driving, or feeding position, within the path of travel 144 shown in FIG. 9 wherein the severing blade 182 is spaced from the slot 153 and the upper textured surface 152. As should be understood, the spring receiving pins cause the helical compression springs to be pressed outwardly against the main frame 131 when the control frame is positioned in the driving or feed position.

An electric solenoid 190 is mounted on the base plate 132 of the main frame 130 between the side plate 133. The electric solenoid has a solenoid arm 191 movable to and from the solenoid in the conventional manner having a distal portion 192 which is suitably received in the channel 160 formed in the lower surface 154 of the mounting plate 151. It should be understood that the solenoid arm has a reduced diameter neck portion 193 which is captured in the channel 160 and that the actuation of the electric solenoid causes the solenoid arm to be retracted into the solenoid so as to move the mounting plate 151 to the retracted or feeding position shown in FIG. 9, against the action of the helical compression springs 135.

The apparatus 10 has a drive motor assembly or drive system 200 consisting of an electric motor 201 mounted in driving relation to a transmission 202. As shown and described herein, the electric motor and transmission are of unitary construction and conventional design. Any suitable electric motor and transmission can be employed in the apparatus. A drive system mount 203 is affixed to the side wall 55 of the housing 25 in spaced relation to the floor 26 on the right as viewed in FIG. 14. The drive system is secured to the mount 203 by a suitable fastener, not shown. The drive system is also mounted to the side wall 55, along the cartridge platform 45, by mounting screws 204 which extend through the side wall and into the transmission 202.

The electric motor 201 has a conventional electric cord 205 having an electric plug 206 at a remote end thereof for insertion in a source of electrical energy such as a wall outlet, not shown. The cord is extended through a rear wall 30 of the cover 28 as can best be seen in FIGS. 7 and 9. A cord retainer 207 is mounted in the rear wall 30 of the housing 25 with the electric cord 205 extended therethrough for purposes of retaining the cord in position within the housing.

The transmission 202 has a drive shaft 210 operably extended therefrom and having a remote end portion 211 positioned above the upper surface 60 of the floor 53 of the cartridge platform 45 for rotation about an axis of rotation 212 substantially parallel to the upper surface 60. A drive wheel 213, having a peripheral surface 214, is mounted on the remote end portion 211 of the drive shaft for rotation about the axis of rotation 212 in a predetermined position such that when the cartridge 80 is disposed in the loaded position as shown in FIGS. 1, 2, 3, 4, 5, 7 and 9, the drive wheel is positioned between the guide rail 95 with the peripheral surface 214 thereof being slightly above the tapered upper edges 96 of the guide rails. This relationship is best illustrated by reference to FIG. 7.

A switch frame 220 is slidably received in the housing 25 in a position closely adjacent but spaced from the front wall 31, as best illustrated by reference to FIG. 2. The switch frame has a remote end 221 which mounts an actuating member 222. The actuating member rests in contact with a second electrical microswitch 223. The second electrical microswitch 223 is of conventional configuration and is not described in significant detail. However, it should be understood that the second electrical microswitch has a spring biased switch which is engaged by the actuating member 222. The switch frame 220 also has a proximal end 224 which mounts a switch cap 225. The switch cap is dimensioned for slidable receipt within the rectangular opening 42 of the top wall 32 of the cover 28. Thus, it will be seen by reference to FIGS. 2 and 9 that depression of the switch cap causes the second electrical microswitch 223 to become electrically closed.

The apparatus 10 has an electrical system 230 shown diagrammatically in FIG. 8. The electrical system includes an electrical conductor 231 operatively interconnecting the electrical plug 206 and the first electrical microswitch 74. Operatively interconnecting the first electrical microswitch 74 and the second electrical microswitch 223 is the electrical conductor 232. An electrical conductor 233 operatively interconnects the second electrical microswitch 223 with the electric motor 201. An electrical conductor 234 operatively interconnects the electric motor and the electric plug 206. The electrical conductors 231 and 234, of course, extend through the electric cord 205 to the electric plug 206 for purposes of connection to a source of electric energy such as an electric outlet. An electrical conductor 235 operatively interconnects the electrical conductor 233 and the electric solenoid 190. The electrical conductor 236 operatively interconnects the electric solenoid to the electrical conductor 234.

OPERATION

The operation of the described embodiment of the subject invention is believed to be readily apparent and is briefly summarized at this point.

The apparatus 10 is loaded by insertion of the cartridge 80 into the housing 25 through the insertion opening 34. It should be understood that the cartridge is disposable and therefore the roll of adhesive tape 11 is already deployed in the internal chamber 123 of the cartridge. As should be appreciated by a close study of FIG. 9, the roll of adhesive tape is received on a mounting assembly generally indicated by the numeral 124. The mounting assembly supports the roll of adhesive tape for rotational movement about the support 125 as well as allowing a swinging or pivoting motion of the roll of adhesive tape about the thin remote portion 126. Such movement may be visualized upon reference to FIGS. 7 and 9 wherein the range of such swinging movement accommodates such movement of the roll of adhesive tape from what may be viewed as a fully gravitational suspended position shown in FIG. 7, to a forward pivoted position shown in FIG. 9.

Once the cartridge 80 has been installed in the apparatus 10 as described, the operator thereof can ascertain the amount of tape remaining on the core 12 by viewing the roll 11 through the viewing port 113 which is formed in the first and second side walls 111 and 112, respectively. Before inserting the cartridge 80 into the apparatus 10, the operator grasps the lead portion 15 of the roll of adhesive tape through the tape cartridge opening 122, and thereafter draws the adhesive tape 14 from the roll and positions it in rested adhesive engagement on the tapered upper edges 96 of the guide rails 95. The cartridge 80 is then inserted through the insertion opening 34 of the rear wall 30 and moved to the fully loaded position shown in FIGS. 7 and 9.

The engagement of the raised ribs 91 with the stops 63 indicates to the operator when the loaded position has been reached. It should be understood that the deployment of the cartridge 80 in the loaded position simultaneously causes the switch member 70 to be depressed, which in turn causes the first electrical microswitch 74 to be placed in an electrically closed state. This relationship is best seen by reference to FIGS. 8 and 14. Moreover, movement of the cartridge to the fully loaded position permits the cartridge locking members 65 to engage the orifice 92, and thus secure the cartridge in the fully loaded position. The movement of the cartridge to the fully loaded position additionally causes the pair of guide rails 95 to move on opposite sides of the drive wheel 213 and thus the lead portion 15 of the adhesive tape 14 to be passed over the peripheral surface 214 of the drive wheel. The lead portion of the adhesive tape is thus disposed in the position shown in FIG. 9. At this same time, however, the control mechanism 130 is disposed in the extended or severing position as shown in FIG. 7 so that the angulated pressure plate 164 is not in engagement with the peripheral surface 214 of the drive wheel.

The apparatus 10 is then connected to a suitable source of electrical energy not shown by connection of the electric plug 206 to the source. When so connected, the apparatus 10 is operable at any time for the dispensing of adhesive tape 14 from the roll 11. Such dispensing is accomplished simply by depressing the switch cap 225 which urges the switch frame 220 to depress the second electrical microswitch 223 thus making a closed electrical system 230. This action simultaneously causes electric motor 201 to rotate the drive wheel 213 in a clockwise direction as viewed in FIGS. 7 and 9 and the electrical solenoid 190 to move the control frame 150 to the retracted or feeding position as shown in FIG. 9. The lower contact surface 173 of the angulated pressure plate 164 engages the lead portion 15 of the adhesive tape 14 and retains it in engagement with the drive wheel 213 so that the drive wheel can feed the lead portion in substantially continuous movement from the source of strip material to be dispensed. As the pressure plate presses the lead portion into tangential engagement with the peripheral surface 214 of the drive wheel 213, the lead portion is thus being disposed in a feeding station substantially tangentially related to the drive wheel. The peripheral surface of the drive wheel contacting the adhesive surface 16 of the lead portion 15 of the adhesive tape reels the lead portion between the severing blade 182 and the mounting plate 151 and from the housing 25 through the dispensing opening 36.

Figure 15:
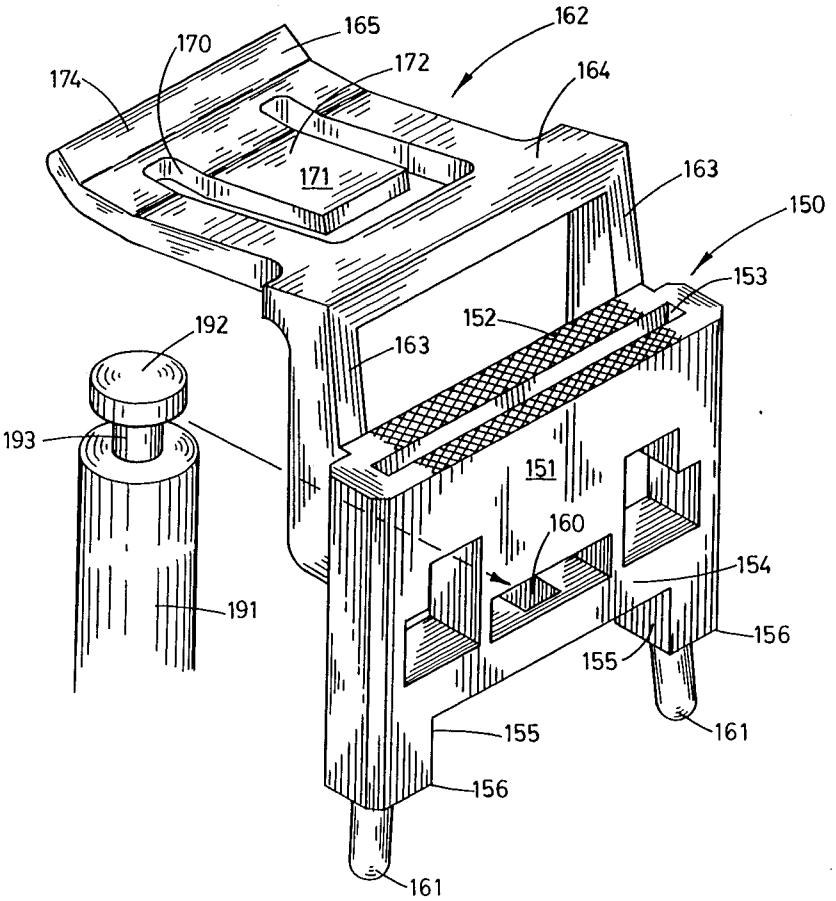
FIG. 15 is a somewhat enlarged, fragmentary, perspective view of the feed plate assembly of the subject invention.
Figure 16:
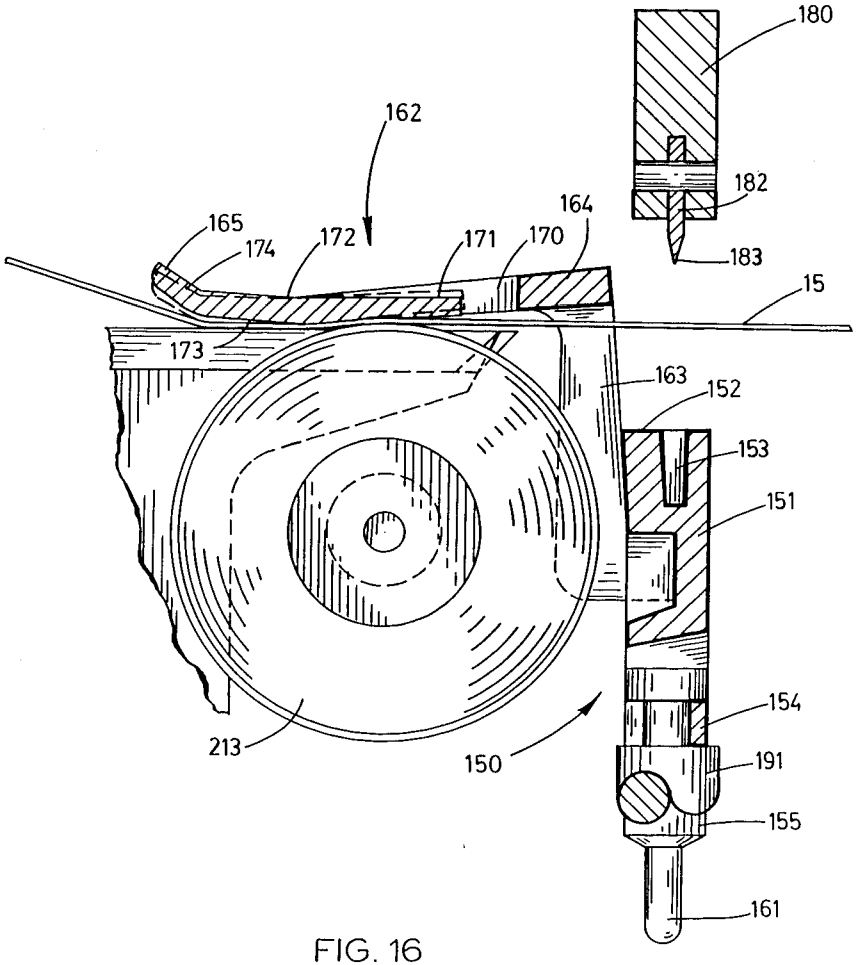
FIG. 16 is a somewhat enlarged, fragmentary, longitudinal vertical section of the feed plate assembly of the subject invention showing the angulated pressure plate thereof in full lines in an initial contact position and in phantom lines in a full contact position in the feeding mode.

As should be appreciated by a study of FIGS. 15 and 16, the angulated pressure plate 164 has formed therein the U-shaped channel 170 which defines the spring member 171. The U-shaped channel defines the spring member which has a width dimension slightly greater than the drive wheel 213. As best appreciated by a study of FIG. 9 and FIG. 16, when the apparatus 10 is in the feeding mode the spring member, which is in contact with the drive wheel, is caused to be flexed upwardly. This upward flexing simultaneously induces the distal end 165 of the feed plate assembly 162 to move downwardly, and thus urges the strip material to be dispensed into substantially tangential relation somewhat slightly behind the apex of the drive wheel. Such dispensing of the tape continues for as long as the switch cap 225 remains depressed. As can be seen in FIG. 9, the pulling effect of the drive wheel upon the lead portion of the tape 15 not only continues to pull the tape from the roll but also pivots the roll of tape in the direction of the dispensing opening.

When the desired length of adhesive tape 14 has been dispensed, the operator simply releases the switch cap 225 which in turn permits the second electrical microswitch 223 to open the electrical system 230. This action immediately terminates the flow of electrical current through the electrical system thereby deactivating the drive motor assembly 200 and the electrical solenoid 190. Such deactivation immediately stops rotation of the drive wheel 213 and allows the helical compression springs 135 to return the control frame 150 to the extended or severing position shown in FIG. 7. As the mounting plate 151 is moved toward the cutting edge 183 and the cutting edge passes the slot 153, the cutting edge severs the adhesive tape in the length desired, such position of the mounting plate constituting a severing station. The action of the mounting plate 151 moving to the severing position also accomplishes another function in that the lead portion of the adhesive tape is drawn from the tapered upper edges 96 of the guide rails 95 and from the peripheral surface 214 of the drive wheel 213 therebetween, due to the adhesive force of the lead portion on the upper textured surface 152 of the mounting plate 151. Once severing occurs, only the very tip of the lead portion 15 remains adhesively attached to the textured upper surface 152. The removal of the tape from the guide rails, and from the peripheral surface of the drive wheel therebetween is accomplished before such severing and therefore only the minimal adhesive retention afforded by the tip of the lead portion is sufficient to retain the new lead portion 15 so formed out of engagement with the guide rail and the peripheral surface of the guide rail.

Still another function is performed by movement of the control frame 150 to the severing position in that the slack in the lead portion 15 of the adhesive tape 14 formed between the mounting plate 151 and the roll is taken up by the gravitational swinging of the roll 11 of adhesive tape back to the fully gravitational suspended position shown in FIG. 7. This action operates to avoid jamming of the device in that such slack is taken up as well as arranging the roll and lead portion in the optimum position for immediate dispensing of a new strip of adhesive tape.

After the initial cycle just described, reoperation of the apparatus 10 can be performed immediately. Upon depression of the switch cap 225, the drive motor assembly 200 and the electric solenoid 190 are again simultaneously operated. The angulated pressure plate 164 is immediately drawn downwardly against the non-adhesive surface 17 of the lead portion 15 to draw the lead portion from adhesive retention of the tip thereof on the upper textured surface 152 and into contact with the tapered edges 96 of the guide rails 95 and the peripheral surface 214 of the drive wheel 213. This relationship is shown in FIG. 9. The operation of the apparatus thereafter is as heretofore described.

As can be visualized upon reference to FIG. 7, when a section 240 of adhesive tape has been severed it remains temporarily adhesively attached at one end on the textured surface 152. The remainder of the section extends out through the dispensing opening 36 and is curved gravitationally downwardly. The plurality of ribs 33 on the housing 25 serve the purpose of allowing adhesive contact by the opposite end of the section of adhesive tape. As a result, the section of adhesive tape is retained temporarily in supported relation on the housing in a curved attitude for grasping by the operator and with only a minimum of contact with its adhesive surface so as to preserve its adhesive properties.

Therefore, it will be seen that the apparatus for dispensing strip material and the like and cartridge therefor of the present invention operate to provide a fully dependable and practical means for dispensing strip material and the like, including adhesive tape, rapidly, in lengths precisely as desired, while minimizing the possibility of jamming in an apparatus which is both of sturdy and dependable construction as well as being inexpensive.

Although the invention has been herein shown and described in what is conceived to be the most practical and preferred embodiment, it is recognized that departures may be made therefrom within the scope of the invention which is not to be limited to the illustrative details disclosed.

Having described our invention, what we claim as new and desire to secure by Letters Patent is:

1. An apparatus for dispensing adhesive tape comprising a housing having a dispensing opening, means borne by the housing for receiving a source of said adhesive tape, means mounted on the housing for selectively feeding adhesive tape from the source and through said dispensing opening along a path in a length selected by the period of operation thereof and gravitationally forming a downwardly extending arc ultimately contacting said housing substantially within a predetermined zone beneath and in spaced relation to said dispensing opening, means mounted on the housing for selectively severing said adhesive tape into selected lengths, and at least one ridge borne by the housing in said zone and extending substantially normal to said path for adhesive engagement by a terminal end of said length of adhesive tape passing from the dispensing opening adhesively to retain said adhesive tape from adhesive contact with other surfaces and in said arc for ease of grasping.

2. An apparatus for dispensing strip material or the like, comprising a housing; a drive wheel mounted on the housing for substantially rotational movement; means for driving the drive wheel in said substantially rotational movement; means mounted on the housing for severing the tape to be dispensed; a disposable cartridge adapted to receive a source of strip material to be dispensed with a lead portion thereof disposed in a ready position, the cartridge movable into the housing to carry said lead portion into feeding relation to the drive wheel; and a control frame, having a feed plate, mounted on the housing for movement along a path of travel between a first position, in which the feed plate engages said lead portion and retains it in engagement with the drive wheel to feed the lead portion upon said rotational movement of the drive wheel in substantially continuous movement from said source, and a second position, in which the control frame places said lead portion in severing engagement with the severing means to sever the lead portion in a selected length.

3. The apparatus of claim 2 wherein the strip material is adhesive tape and the cartridge has a feeding assembly mounting a pair of guides that are adapted to be engaged by the lead portion of the tape during movement of the cartridge into the housing to carry the lead portion of the tape into overlaying relation to the drive wheel.

4. The apparatus of claim 3 including means borne by the housing for releasably securing the cartridge in the housing with said lead portion of the tape in overlaying relation to the drive wheel.

5. The apparatus of claim 2 wherein the strip material is adhesive tape, the control frame has a mounting plate with a textured upper surface for contact with the adhesive of the lead portion of the adhesive tape for movement thereof between said first and second positions and the textured surface has a slot adapted to receive the severing means for severing of said lead portion in the second position.

6. The apparatus of claim 5 wherein the control frame has a downwardly extending pin about which is positioned a coil spring engaging the housing at its opposite end resiliently to urge the control frame to the second position.

7. The apparatus of claim 5 wherein said feed plate has a U-shaped channel defining a spring member for resiliently retaining the tape, when the control frame is in the first position, in substantially tangential engagement and somewhat slightly behind the apex of the drive wheel with respect to the direction of movement of the tape by the drive wheel.

8. The apparatus of claim 7 wherein the feed plate has a distal end so related to said spring member that when the control frame is in the first position, the spring member is flexed upwardly by contact with said tape overlaying the drive wheel to urge said distal end of the feed plate downwardly against the tape just rearwardly of the drive wheel relative to the direction of movement of the tape by the drive wheel.

9. In an apparatus for dispensing strip material or the like, the apparatus having a housing, a source of strip material to be dispensed mounted in the housing, a drive wheel for feeding a lead portion of the strip material from said source and from the housing in a feeding direction of travel and means for severing the strip material, an improvement comprising:

A. a control frame mounted for reciprocal movement in the housing between a first position in strip material feeding relation to the drive wheel and a second position in strip material severing relation to the severing means, the control frame having:

(1) a mounting plate having an upper textured surface having a slot for receiving the severing means and said mounting plate having a lower surface;

(2) a pair of pins mounted on and depending from the lower surface of the mounting plate and extending in diverging relation from each other; and (3) a feed plate assembly mounted on and extending outwardly from the mounting plate and including a pressure plate having a distal end and a U-shaped channel defining a flexible spring member engageable with said lead portion of the strip material when the control frame is in the first position in such a way that the spring member flexes sufficiently to induce the distal end of the pressure plate to move the lead portion of the strip material into substantially tangential relation to and slightly behind, relative to said feeding direction of travel, an apex of the drive wheel;

B. a pair of coil springs individually captured between the mounting plate and the housing about the pins of the control frame resiliently to urge the control frame to the second position; and C. a solenoid interconnecting the control frame and the housing selectively operable to move the control frame from the second position to the first position.

10. The apparatus of claim 9 wherein the U-shaped channel which defines the spring member has a width dimension slightly greater than that of the drive wheel to accommodate said drive wheel.

11. The apparatus of claim 10 wherein the distal end of the pressure plate is upwardly bent so as not to bind against the strip material in the first position.

12. A disposable cartridge for mounting a source of strip material to be dispensed in an apparatus for dispensing strip material therefrom, the disposable cartridge comprising:

a cartridge base having upright side walls with leading edges individually mounting upwardly deployed guide rails disposed in spaced relation for passage on opposite sides of a drive means within said apparatus; and a container mounted on the cartridge base for housing a roll of strip material, said container having opposite walls interconnected by a mounting number extending through said roll of strip material and mounting a substantially flat plate interconnecting said opposite walls of the container and canted toward said guide rails for extension of a lead portion of said strip material for adhesive overlaying engagement with said guide rails.

13. The disposable cartridge of claim 12 wherein said guide rails are borne by mounting plates individually mounted on and extending from the upright side walls of the cartridge toward each other in a substantially common plane to terminal edges disposed in predetermined spaced relation and upwardly from which said guide rails extend in substantially parallel relation for passage on opposite sides of said drive means and serrated blades disposed in substantially upwardly facing relation interconnecting each of said mounting plates and its respective guide rail.

* * * * *

UNITED STATES PATENT AND TRADEMARK OFFICE

CERTIFICATE OF CORRECTION

PATENT NO. : 4,848,201

DATED : July 18, 1989

INVENTOR(S) : Peter R. Urwyler; John W. Toor; James W. Sacherman

It is certified that error appears in the above-identified patent and that said Letters Patent is hereby corrected as shown below:

Column 2, Line 68

Delete "therefor" and insert ---thereof---

Column 3, Line 29

Delete "i" and insert ---in---

Signed and Sealed this

Twenty-second Day of May, 1990

*Attest:*

HARRY F. MANBECK, JR.

*Attesting Officer*

*Commissioner of Patents and Trademarks*